US007172222B1

(12) United States Patent
Hotovy

(10) Patent No.: US 7,172,222 B1
(45) Date of Patent: Feb. 6, 2007

(54) CONCEALED SPRING MARINE GATE LATCH

(75) Inventor: Robert Hotovy, New Buffalo, MI (US)

(73) Assignee: The Godfrey Conveyor Company, Inc.

( * ) Notice: Subject to any disclaimer, the term of this patent is extended or adjusted under 35 U.S.C. 154(b) by 150 days.

(21) Appl. No.: 10/944,663

(22) Filed: Sep. 17, 2004

Related U.S. Application Data

(60) Provisional application No. 60/504,386, filed on Sep. 18, 2003.

(51) Int. Cl.
*E05C 5/02* (2006.01)
*E05C 1/02* (2006.01)
*E05C 1/12* (2006.01)
*E05C 1/10* (2006.01)

(52) U.S. Cl. ..... 292/57; 292/137; 292/174; 292/175

(58) Field of Classification Search ..... 292/175, 292/174, 145, 57, 347, 137, 60, 61, 163, 292/150, DIG. 29; 256/49, 73, 65.05; 114/203, 114/116
See application file for complete search history.

(56) References Cited

U.S. PATENT DOCUMENTS

| | | | | | |
|---|---|---|---|---|---|
| 504,262 | A * | 8/1893 | Adams | 292/62 |
| 1,720,492 | A * | 7/1929 | Pollock | 292/179 |
| 4,791,756 | A * | 12/1988 | Simpson | 49/175 |
| 5,042,854 | A * | 8/1991 | Huang | 292/175 |
| 5,125,695 | A * | 6/1992 | Hartwell | 292/62 |
| D351,781 | S * | 10/1994 | DeWitt | D8/344 |
| 5,618,066 | A * | 4/1997 | Fu-Hsiang | 292/62 |
| 5,746,455 | A * | 5/1998 | Takimoto | 292/62 |
| 6,854,414 | B1 * | 2/2005 | Huntley | 114/364 |

* cited by examiner

*Primary Examiner*—Brian E. Glessner
(74) *Attorney, Agent, or Firm*—Botkin & Hall, LLP

(57) ABSTRACT

A latch useable to secure a gate such as typically found on a pontoon boat includes a latch bolt slidably received within a barrel. A spring interposed between the bolt and the back end of the barrel maintains the bolt in an extended position protruding out the mouth of the barrel until the bolt is retracted back within the barrel. A cover carried by the latch bolt prevents debris from entering the spring area in the barrel, which could interfere with the latch's action. The latch secures the gate in its closed position with the bolt extending into a complementary receiver carried by the adjacent wall.

4 Claims, 7 Drawing Sheets

CONCEALED SPRING MARINE GATE LATCH

CROSS REFERENCE TO RELATED APPLICATIONS

This application is a continuation of and claims the benefit of Provisional U.S. Patent Application No. 60/504,386, filed Sep. 18, 2003.

BACKGROUND OF THE INVENTION

1. Field of the Invention

The invention disclosed herein relates to a latch for securing a swing gate on a marine vehicle such as a pontoon boat or deck boat.

2. Discussion of the Background Art

For pontoon boats and deck boats with tubular constructed gates and rails it is desirable to be able to secure the gate in a closed position in relation to the rails. It was customary to secure the gate in its closed position with hinges having elongated vertical slots that allowed the gate to be lifted and then dropped into a pocket in its closed position. The gate pocket typically would be secured to the deck or adjacent rail and prevented the gate from opening due to gravitational forces holding the gate within the pocket. With recent developments in guideline specifications such as the American Boat and Yacht Counsel (ABYC) Specifications 41.6.3.5-6 this method of latching the boat gate is no longer acceptable.

The ABYC Specifications require a latching device that can not be accidentally disengaged and that can also resist or withstand a four hundred pound static load at any point and in any direction without failing. The drop pocket latching mechanism described is inadequate to meet these specifications because a sudden jolt as might be experienced when the boat goes over a large wave can cause the gate to open accidentally. The gate pocket can also present a tripping hazard since it is located near the floor near the gateway. Therefore it would be desirable to have a latch for a pontoon or deck boat railing gate that can not be accidentally disengaged and that can withstand a four hundred pound static load.

One such prior art latch that answers these needs is shown in FIG. 1. In this latch, a bolt is slidably carried within an elongated sleeve. The sleeve is secured to the gate such that the bolt extends through the end of the gate and into a complementary receiver hole in the wall. The bolt may be secured in its extended position by rotating a handle into a radially offset groove. The bolt may then be retracted by rotating the handle into alignment with a longitudinal slot in the case sleeve and sliding the bolt back along the slot. The bolt may then be secured in its retracted position by rotating the handle into a second radially offset groove or slot. When the bolt is in its retracted position the gate may be freely opened or closed. The gate is securely latched when the bolt is in its extended position through the gate and the wall. With the bolt in its extended position the latch may be locked by rotating the handle into the radially offset slot. Although this latching mechanism satisfies the ABYC requirements, it would be desirable to have a less cumbersome latching mechanism that is simpler to operate and less obtrusive.

SUMMARY OF THE INVENTION

The invention disclosed herein includes a bolt slidably carried within a barrel between an extended position and a retracted position. A resilient member carried by the barrel engages the bolt to urge it toward its extended position. A handle on the bolt extends out of the barrel through an elongated slot in the barrel. An elongated projection extending from the bolt covers the slot in the barrel when the bolt is in its extended position.

An object of the invention is to provide a latch for a pontoon or deck boat that will releasably secure a gate in its closed position and can not be accidentally disengaged.

BRIEF DESCRIPTION OF THE DRAWINGS

These and other aspects of the invention will be apparent from the following description, with reference to the accompanying drawings, in which.

DETAILED DESCRIPTION

Figure 1:
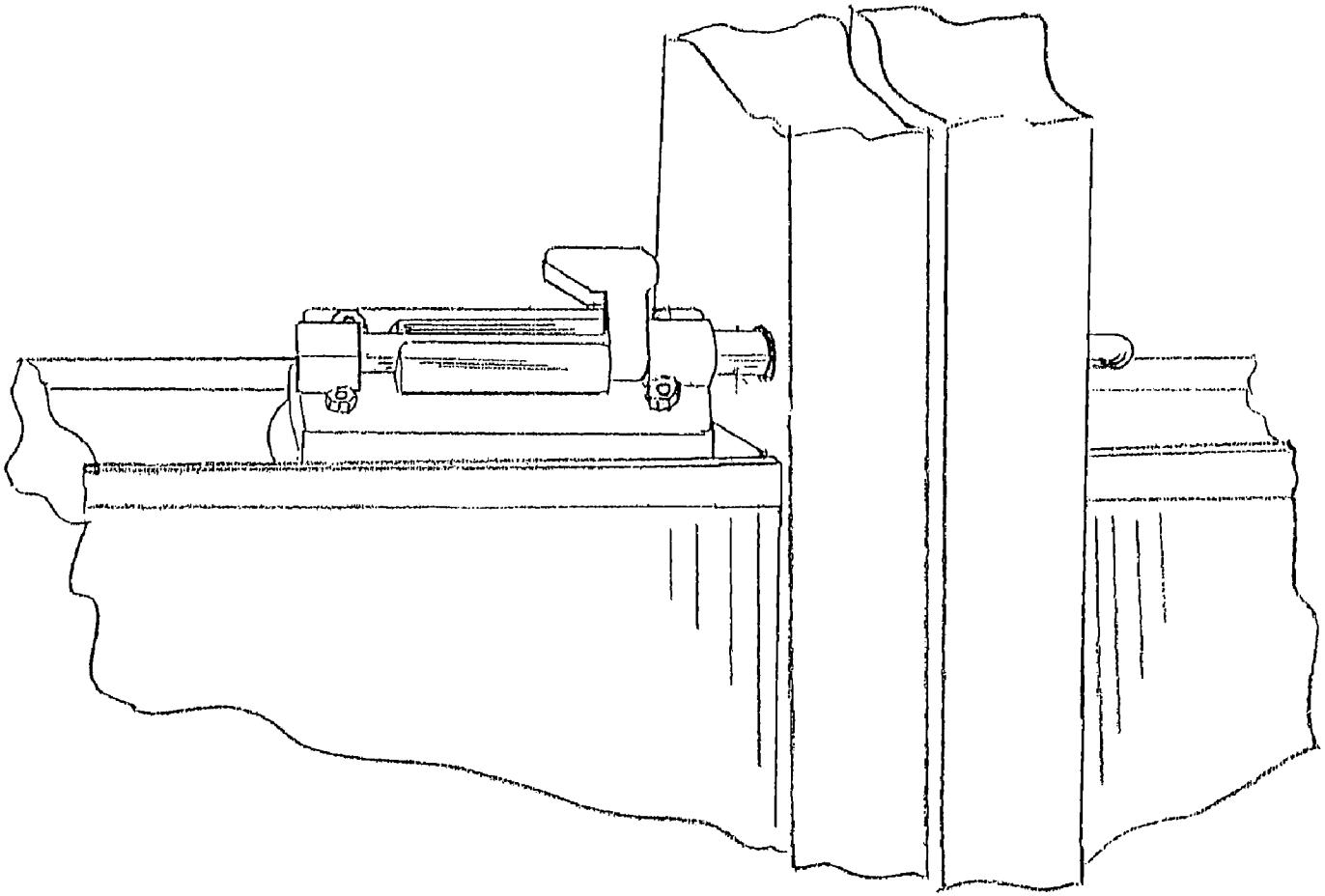
FIG. 1 PRIOR ART
FIG. 1 shows the prior art gate latch discussed in the background of the invention.

Referring now to FIGS. 2 through 11, a latch 10 is carried by a gate 12 across a portal 14 in a wall 16. Gate 12 and wall 16 are of generally tubular metal construction with panels interspersed between the tubes as may generally be found on pontoon boats and deck boats. Gate 12 includes a frame 18 and an upper cross bar 20. Wall 16 includes a portal frame 22. Gate 12 pivots between an open position angularly disposed relative wall 16 and a closed position with its frame 18 aligned with frame 22.

Figure 2:
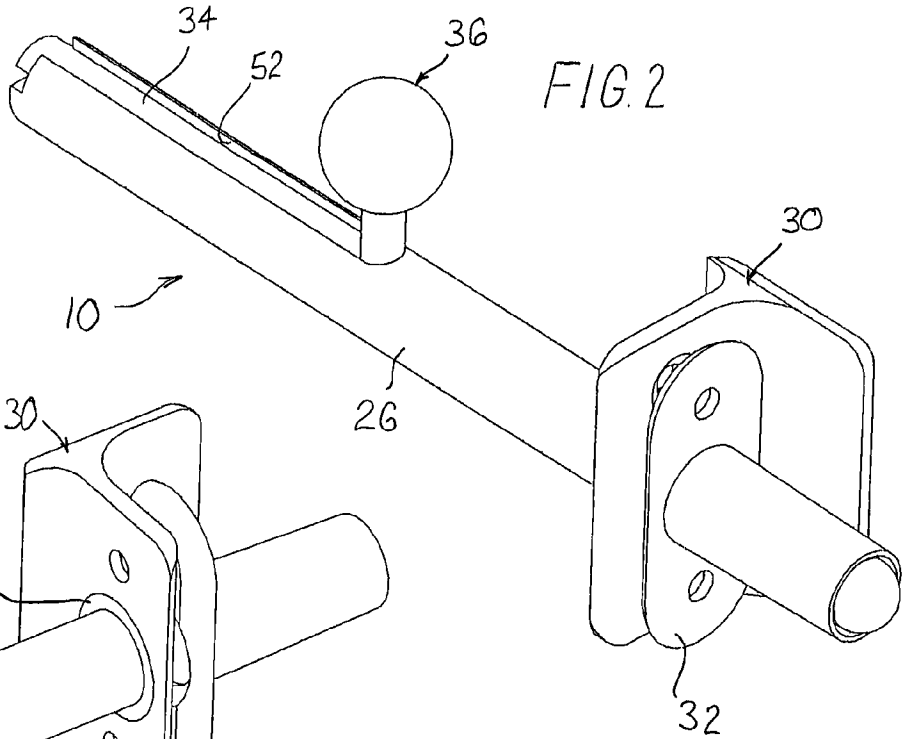
FIG. 2 is a perspective view of a latch according to this invention in its closed position.
Figure 3:
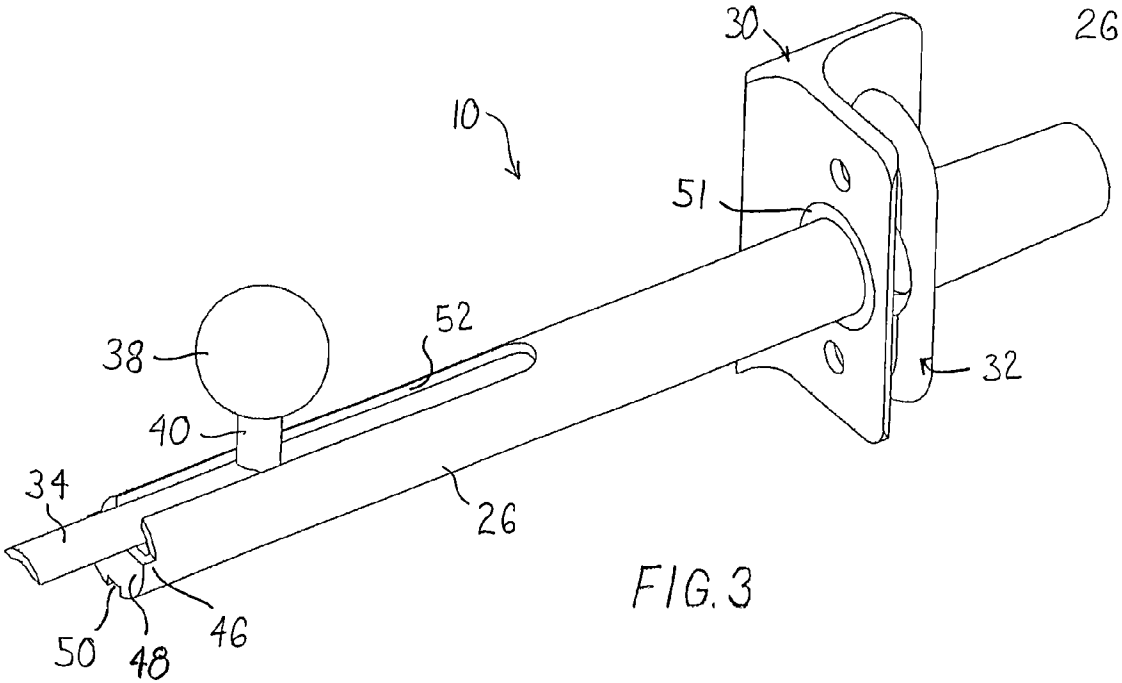
FIG. 3 is a perspective view of the latch in an open position.
Figure 4:
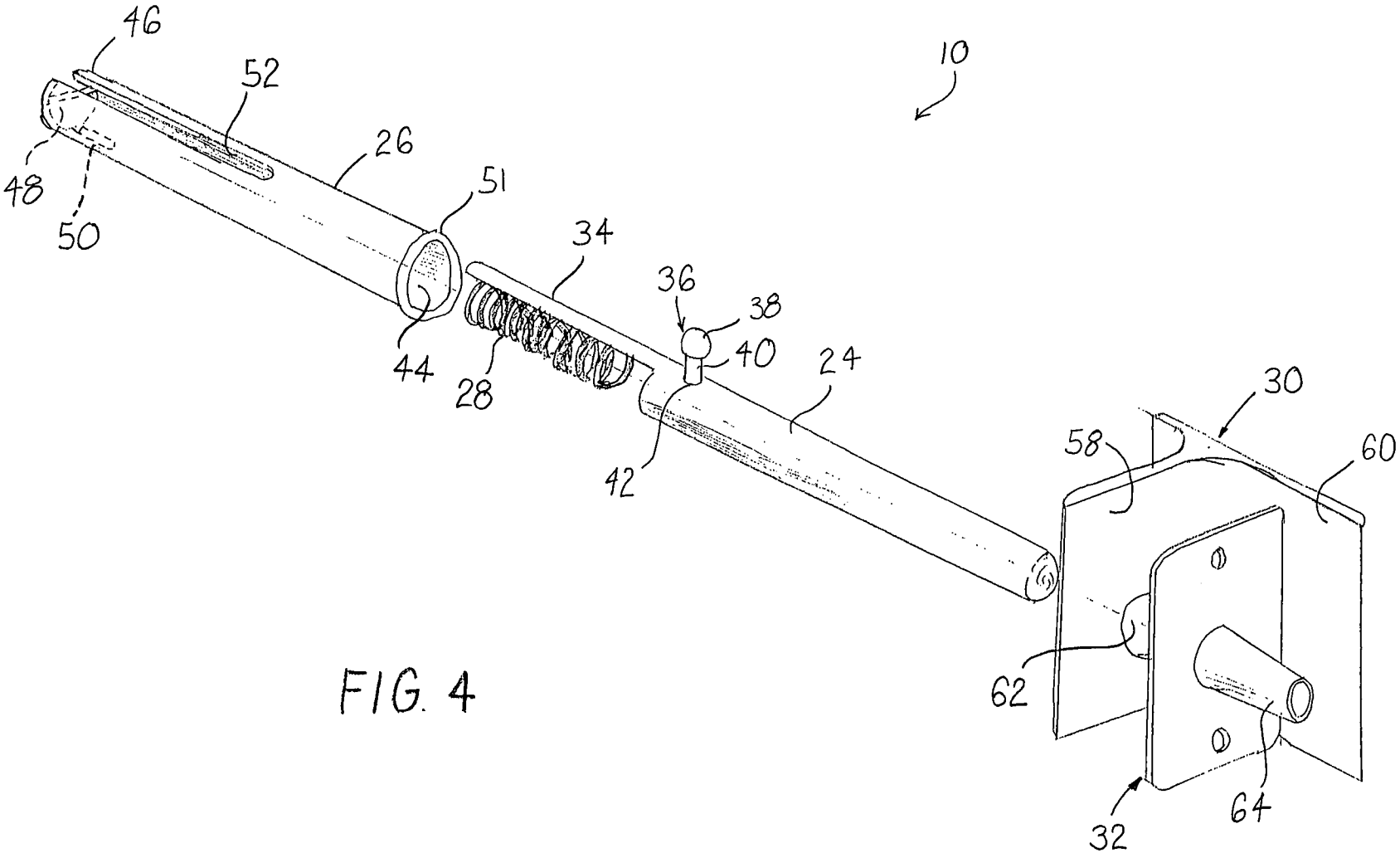
FIG. 4 is an exploded view of the latch and its subcomponents.
Figure 5:
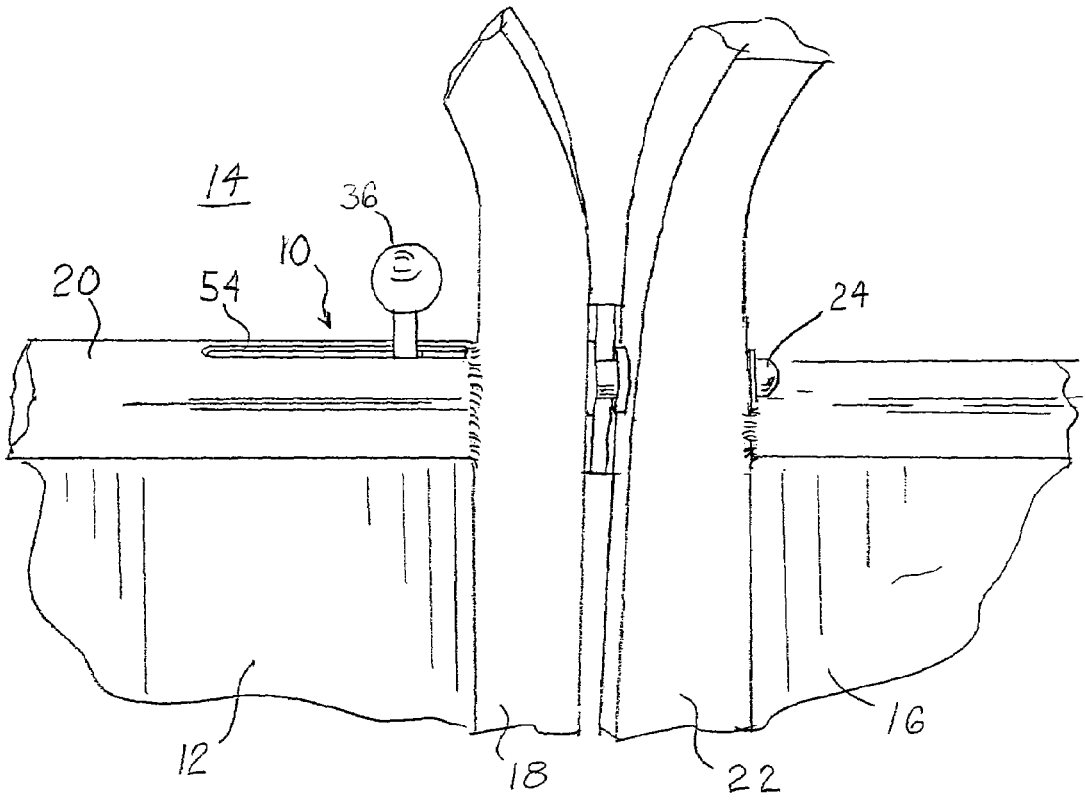
FIG. 5 shows the latch installed on a marine gate and in its closed position.
Figure 6:
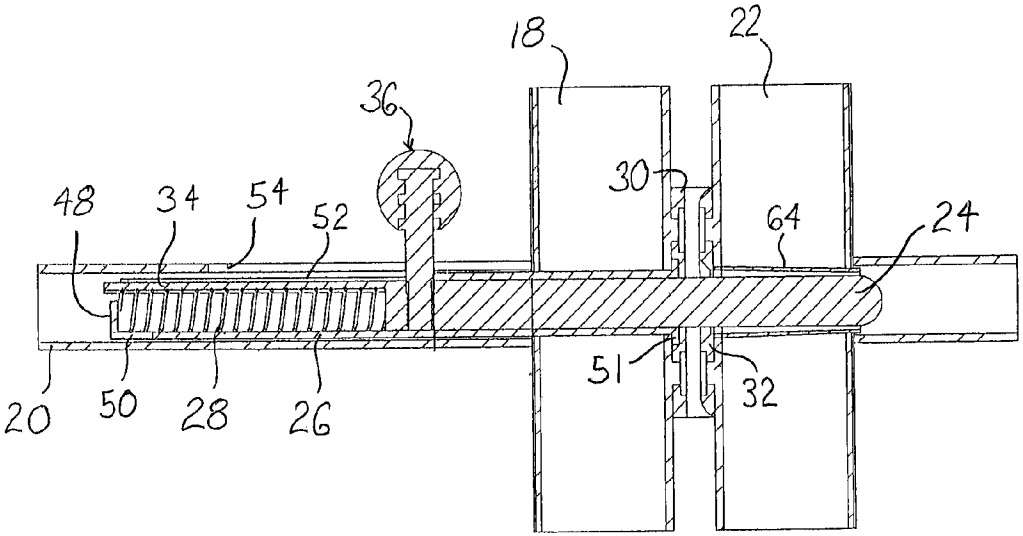
FIG. 6 is a cross section of the latch and gate with the latch in its closed position.
Figure 7:
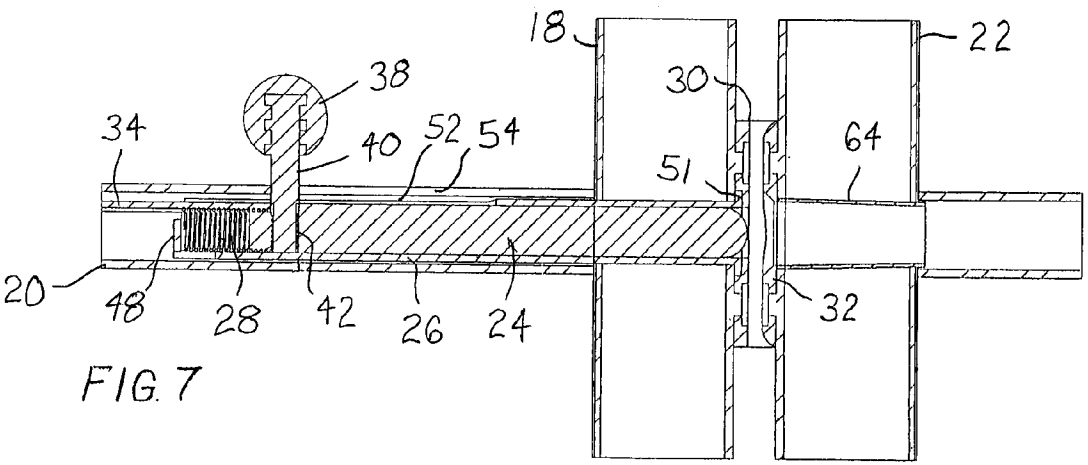
FIG. 7 is a cross section of the latch and gate with the latch in its open position.
Figure 8:
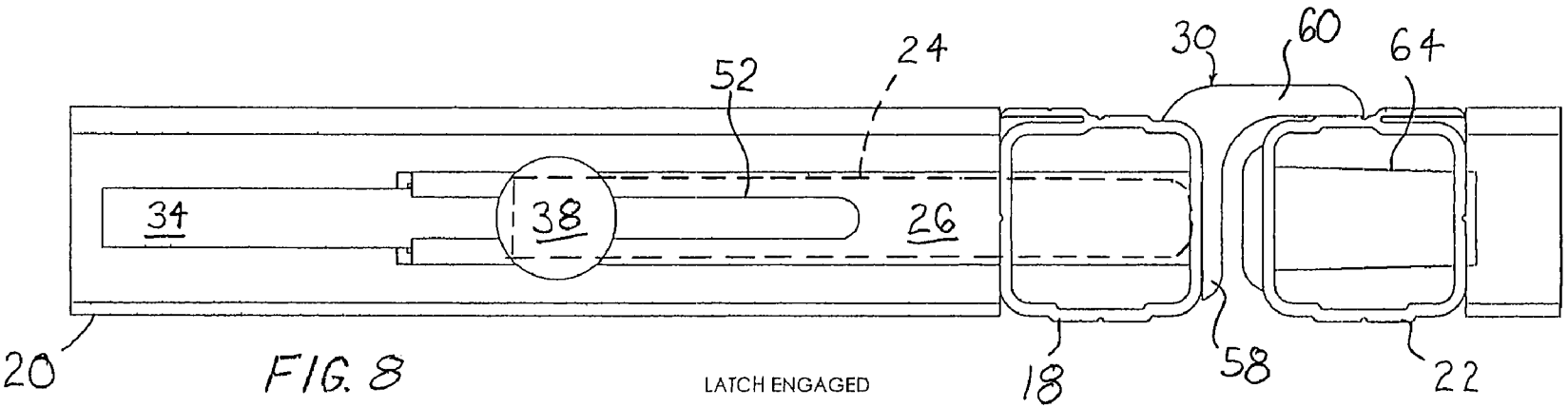
FIG. 8 is a top view of the latch installed on a gate with portions removed for illustrative purposes with the latch in its open position.
Figure 9:
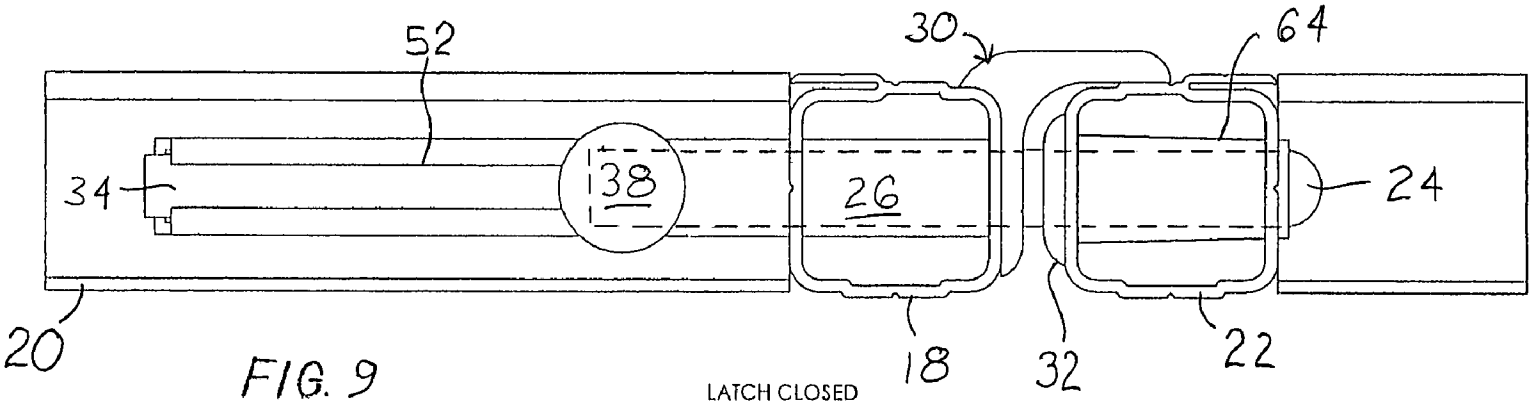
FIG. 9 is a top view of the latch installed on a gate with portions removed for illustrative purposes with the latch in its closed position.
Figure 10:
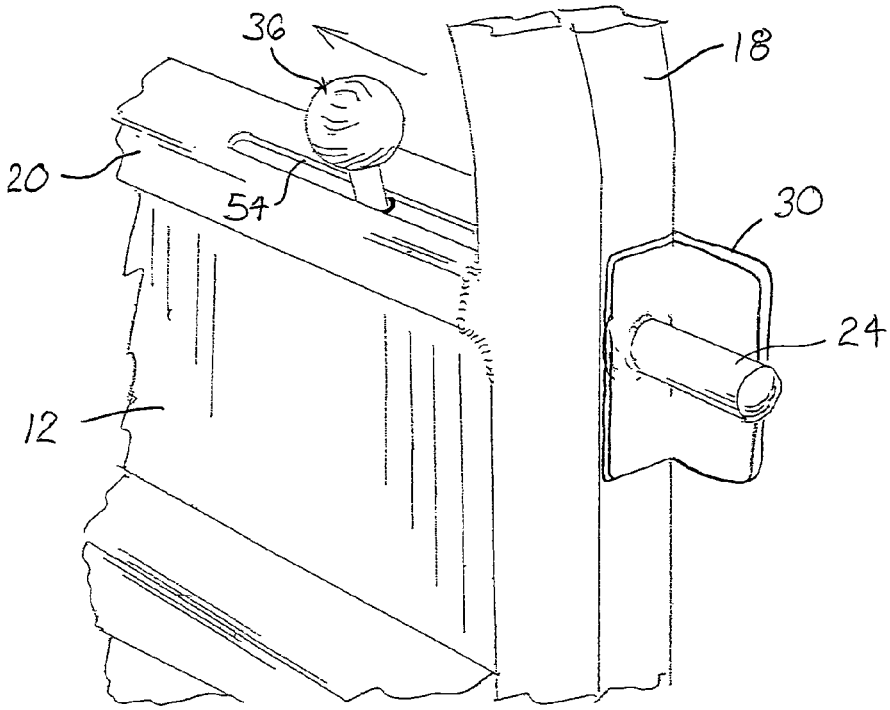
FIG. 10 is a perspective view of the latch as it is installed on a gate in its closed position.
Figure 11:
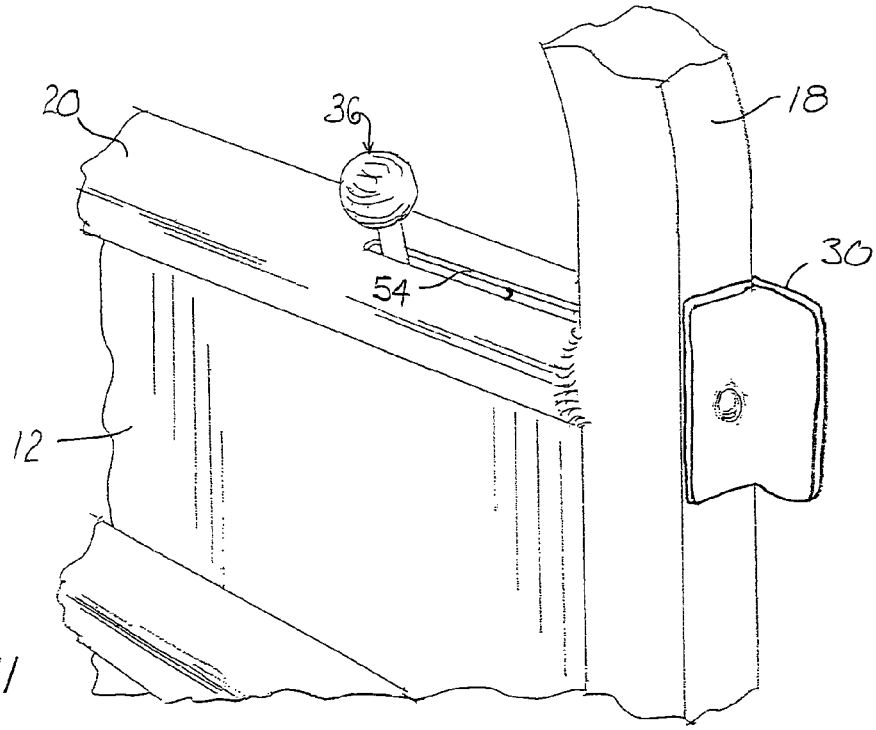
FIG. 11 is a perspective view of the latch as it is installed on a gate in its open position.

Latch 10, as best seen in FIGS. 2 through 4 includes a latch bolt 24, a tubular barrel 26, a helically wound spring 28, a stop 30, and a bolt receiver 32. Latch bolt 24 is a generally elongated cylindrical member with a spring cover or bayonet projection 34 extending from one end of the bolt. A handle 36, including a knob 38 on a threaded shaft 40, is screwed or threaded into a complementary threaded hole 42 in latch bolt 24 in longitudinal alignment with spring cover 34. Barrel 26 is of an elongated tubular form sized to slidingly accept latch bolt 24. Barrel 26 includes an open mouth end 44, a butt end 46 partially covered with a half plate 48, a drain hole 50 adjacent the butt end, and an elongated open channel or slot 52 extending longitudinally from the butt end opposite drain hole 50. A circular lip 51 is formed about mouth 44. Latch bolt 24 is slidably fitted within barrel 26 such that spring cover 34 is aligned with slot 52. Spring 28 is interposed between and engages half plate 48 and latch bolt 24 underneath spring cover. Shaft 40 of handle 36 projects through slot 52 to expose knob 38 for manipulation by a user.

Latch bolt 24 may be slidably shifted between an unlocked or retracted position and a locked or extended position. In its locked position, shown in FIG. 2, bolt 24 is in an extended position projecting out from the mouth end 44 of barrel 26. Spring 28 urges bolt 24 into its locked position outwardly through mouth 44 until shaft 40 of handle 36 engages the end of slot 52 in barrel 26. In its unlocked position, best seen in FIG. 3, latch bolt 24 is retracted within barrel 26 such that the bolt is essentially even with mouth 44, and spring cover 34 protrudes out from butt end 46 above half plate 48. In its unlocked position, latch bolt 24 compresses spring 28 against half plate 48 such that bolt 24 must be secured or held to maintain the bolt in its retracted or unlocked position. Once handle 36 or bolt 24 is released, spring 28 will urge latch bolt 24 to return to its locked position.

Focusing on FIGS. 5 through 11, latch 10 is shown as it would be installed in gate 12 in order to be able to latch the gate in its closed position. Latch 10 extends through gate frame 18 and is carried within gate cross bar 20 such that lip 51 of mouth 44 of barrel 26 contacts the end surface of the gate frame. A longitudinal slot 54 previously formed in cross bar 20 is aligned with slot 52 in barrel 26 to permit handle 36 to project outwardly of cross bar 20. Shaft 40 of handle 36 travels along slot 54 as bolt 24 shifts between its locked and unlocked positions.

Stop 30 is carried by gate frame 18 in alignment with latch bolt 24. Stop 30 includes a mounting portion or plate 58 and a stop part 60. Mounting plate 58 is secured flush against the end of gate frame 18 between the gate and the wall overlying lip 51 of the barrel to secure the barrel within the cross bar. Stop part 60 projects outwardly of and generally perpendicular to the mounting plate, abutting wall 16 when gate 12 is closed. A hole 62 in mounting plate 58 aligned with latch bolt 24 allows the latch bolt to extend through the mounting plate when in its locked position. Bolt receiver 32 is carried by portal frame 22 of wall 16 opposite mounting plate 58 and includes a tapered receiver barrel 64 which extends into the portal frame and is aligned with latch bolt 24.

In its locked position, latch bolt 24 protrudes out from mouth end 44 of barrel 26 and hole 62 in mounting plate 58 of stop 30 into receiver barrel 64, thereby effectively preventing gate 12 from opening. To open gate 12, latch bolt 24 is retracted by sliding the latch bolt back within barrel 26 using handle 36 until the latch bolt clears bolt receiver 32. Gate 12 may then be swung open. Releasing handle 36 allows spring 28 to urge bolt 24 into its extended or locked position. To re-latch gate 12 in its closed position, latch bolt 24 must again be retracted into barrel 26 so that the gate may be aligned with wall 16. Handle 36 is then disengaged thereby allowing spring 28 to urge latch bolt 24 into its latched position extending into receiver barrel 64.

In the latch's assembled position within the gate, slots 52 and 54 open generally upwardly and drain hole 50 opens generally downwardly. This allows any water that is accumulated within barrel 26 to drain out of the barrel through the drain hole. Spring cover 34 extends across slot 52 within barrel 26 to prevent debris from entering the barrel and potentially interfering with the action of spring 28 or latch bolt 24. If latch bolt 24 needs to be completely removed from barrel 26, handle 36 may be removed from the bolt by unscrewing shaft 40 from the bolt, thereby allowing the bolt to be slid from the barrel through mouth 44 and out stop 30.

The detailed description hereinbefore related is only meant to exemplify the invention to enable those skilled in the art to make and use it. The subject invention is not to be limited to the details given above for the preferred embodiment, but may be modified within the scope of the impending claims.

I claim:

1. A latch for releasably securing a gate in a closed position along a wall, said latch comprising an elongated barrel having an open mouth end and a covered end opposite said mouth end, said barrel adapted to be carried by said gate, an elongated channel opening along said barrel and extending to said covered end forming an opening in the top portion of said covered end, a bolt slidably carried within said barrel and being shiftable between a retracted position inside said barrel and an extended position projecting from said barrel, a spring carried within said barrel between said bolt and said covered end, said spring urging said bolt toward its said extended position, a bolt receiver adapted to be carried by said wall, said bolt when in its said extended position protruding into said bolt receiver, a handle carried by said bolt and extending outwardly of said elongated channel, an elongated bayonet projection extending axially from one end of said bolt aligned with said elongated channel, said bayonet projection covering only a top portion of said spring, directly below said elongated channel, said bayonet projection extending through said opening when said bolt is in its said retracted position.

2. The latch of claim 1 wherein said barrel has a downwardly oriented opening therethrough for allowing the escape of entrapped water from said barrel.

3. The latch of claim 1 and further comprising a stop part adapted to be carried by said gate and extending therefrom, said stop part adapted to abut said wall when said gate is in its said closed position.

4. The latch of claim 2 wherein said barrel is adapted to be carried within said gate.

* * * * *